US005143102A

United States Patent [19]

Blaul

[11] Patent Number: 5,143,102

[45] Date of Patent: Sep. 1, 1992

[54] HIGH PRESSURE PARTS CLEANER AND METHOD

[75] Inventor: Ronald L. Blaul, Crystal Lake, Ill.

[73] Assignee: Graymills Corporation, Chicago, Ill.

[21] Appl. No.: 495,050

[22] Filed: Mar. 12, 1990

[51] Int. Cl.[5] ..... B08B 3/02

[52] U.S. Cl. ..... 134/58 R; 51/321; 51/426; 134/113; 134/172; 134/200

[58] Field of Search ..... 134/10, 27, 101, 109, 134/111, 113, 172, 179, 200, 58 R; 51/321, 425, 426

[56] References Cited

U.S. PATENT DOCUMENTS

| | | | |
|---|---|---|---|
| 2,576,008 | 11/1951 | Gladfelter et al. | 51/426 |
| 3,103,765 | 9/1963 | Nolan | 51/426 X |
| 3,300,902 | 1/1967 | Dockery | 51/426 |
| 3,352,063 | 11/1967 | Eppler | 51/426 |
| 3,522,814 | 8/1970 | Olson | 134/113 X |
| 3,553,895 | 1/1971 | Power | 51/321 X |
| 3,656,493 | 4/1972 | Black et al. | 134/113 |
| 3,921,653 | 11/1975 | Ducharme | 134/200 X |
| 3,930,879 | 1/1976 | Erickson et al. | 134/109 X |
| 3,999,564 | 12/1976 | Pesek | 134/111 X |
| 4,676,261 | 6/1987 | Blaul | 134/111 X |
| 4,784,168 | 11/1988 | Erminio | 134/177 X |
| 4,796,042 | 1/1989 | Mappin et al. | 134/10 X |
| 4,928,440 | 5/1990 | Hughes | 51/426 |

*Primary Examiner*—Philip R. Coe
*Attorney, Agent, or Firm*—Wood, Phillips VanSanten, Hoffman & Ertel

[57] ABSTRACT

High pressure parts cleaner having: grit blaster, as well as hand directed and machine oscillated spray nozzles; an enclosing part's chamber defining a spray zone of the nozzles and a collecting basin therebelow which holds the parts; and a base of neutralizing drums supporting the collecting basin. The basin communicates with the base, allowing the drums to act as receptcles for filtering and chemically neutralizing therein the run-off of expended cleaners. The drums continually directly discharge the thus acceptable effluent by regular sewage disposal.

8 Claims, 7 Drawing Sheets

HIGH PRESSURE PARTS CLEANER AND METHOD

This application relates to a parts cleaner and method employing high pressure. It more particularly relates to a versatile and forceful method and cleaning apparatus fitting in compatibly with the outside environment, and doing it by flow-through with neutralizing so that the steady discharge does not introduce contamination, deposits or drain damage to the outside.

The concern to prevent pollution and other harm to the environment is especially important because of ecology considerations Machines utilized by engine and auto mechanics who frequently clean removed parts have generally consisted of specialized units such as provide, for example, a spout under which the parts are washed off, usually in a stream or else a spray of petroleum solvent; or sometimes by ultrasonic cleaning in a solvent bath. If the parts happen to be coated with rust instead of the oily grime usually encountered, then they are wire-brushed by hand according to practice in the past; or else by an electric brush, or with the rust removal done in specialized apparatus such as a blasting machine. It is therefore the practice to remove some or all of a sequence of parts from one station to other work stations for other phases of cleaning required.

I find these existing expedients somewhat lacking in orderly coordination, time-saving, efficiency, automatic operation, and in the convenience of handling sequences of parts all in one place.

It is an object of the present invention to materially reduce or substantially eliminate the foregoing drawbacks and other disadvantages of parts' cleaning as just described. Some background cleaning patents restricted as to teaching mineral solvent or blasting as above include, along with the publication Abstract Number PCT/CH 80/00029 priority date Mar. 26, 1979 published Oct. 2, 1980, U.S. Pat. Nos. 4,170,488; 2,797,530; 3,542,592; 3,416,544; 4,101,340; 4,038,155; 4,052,227; 3,971,394; 2,677,381; 4,098,033; 4,676,261; and 4,886,081.

A further object arises in connection with existing wash-down dollies commonly present for mechanics' use in cleaning out their work areas, and here resides in an invention specifically capable of using, for its purposes, the available wash-down solution already of utility to the mechanics and furnished for their own housekeeping use over the areas. So because of my invention's intentional compatibility, no additional outlay is required for producing hot washing solution in order for my machine to be operational.

Another object in line with the preceding objective is the combination, with the spray washer in my cleaner, of a blast capability for the parts utilizing abrasive and affording a unique two-stage cleaning operation: a part in a batch bearing light rust is first gun-abraded clean then, second, another part grimy and greasy and with some under-rust is sprayed off to degrease it and expose the rust, whereupon the first stage with the gun is then repeated to abrade off the surface rust remaining. And so on, with a following part or batch requiring such cleaning.

An additional object, in line with the immediately preceding objective, is automatically to keep internally chemically neutralizing the expended sludge of abrasive and wash water being run off from within the cleaner as it continues functioning. That is, consolidating with the respective hand and machine sprayers which each discharge the run-off of the wash water as used, the contemporaneously running neutralizer which is internally chemically treating that run-off in necessary way.

It is another object of my invention to provide a safety switch continually effective, whenever batch changes are being made in the machine or the machine is otherwise being left open, to electrically disable the several controls provided each of which if inadvertently operative would, highly undesirably, allow full flow in the system discharge of neutralizer chemical introduced in full strength.

A further object, in connection with the soapy water wash-down output being made readily available to my cleaner for parts' washing, is the combination in the cleaner of both a spray nozzle for hand directed washing and a machine-oscillated nozzle for pre-set timed periods of machine washing, so as to afford a unique two-phase selection in sequences of parts for their differences in treatment method required.

An additional object, in the matter of a cleaner viewing window for necessary effective hand nozzle washing, resides in the provision on the window of an air nozzle therefor which is pulsed and thus directed to blow with gusts intermittently on the underside of the window for improved effectiveness in defogging the underside surface.

Another object, for purpose of calling into operation a high pressure pump supply of soapy water for spray washing, is the provision of an electrical actuating circuit for the pump which is under the improved and highly convenient control of a knee operated switch presented to the operator of the cleaner.

A further object is coordination, with the spraying and blasting and its resulting sludge of abrasive and dirty wash water, of a concomitant flow of the chemical neutralizer into the latter, as tied in by automatic sensitivity for and exact response to all knee-switch usage. Equally if not more significantly, the sudsy commercial washing products available and suitable here are to a great extent, if not wholly so, biodegradable. The resulting wash water, once treated with my neutralizer, is disposable without encountering problems such as the mineral solvents' drawbacks of requiring on-site storage, subsequent haulage by tanker truck, and finally a complicated solvent disposal procedure.

An additional object is the provision of a coupling which can be brought into selective engagement with the knee switch, and which is constructed and arranged to bring the air nozzle into defogging operation coordinated with all times of spray washing.

Further features, objects, and advantages will either be specifically pointed out or become apparent when, for a better understanding of my invention, reference is made to the following description taken in conjunction with the accompanying drawings which show certain preferred embodiments thereof and in which.

Figure 1:
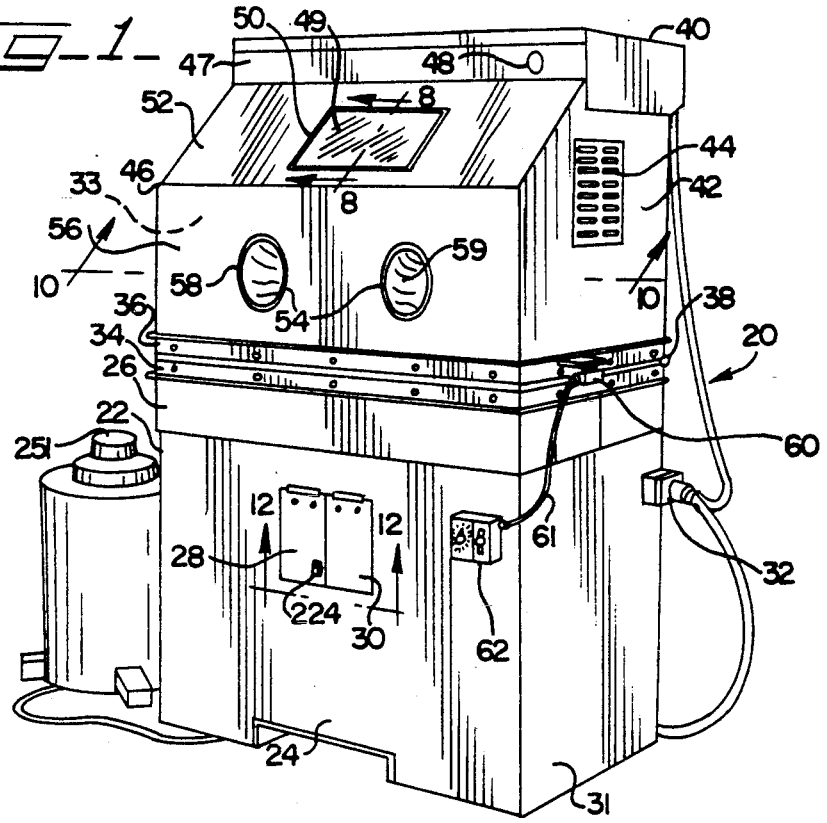
FIG. 1 is an isometric view of my combination cleaner as fully assembled with an open-close cleaning cabinet or hood, a base therefor, and a tray basin supported on the base and supporting the cabinet.
Figure 2:
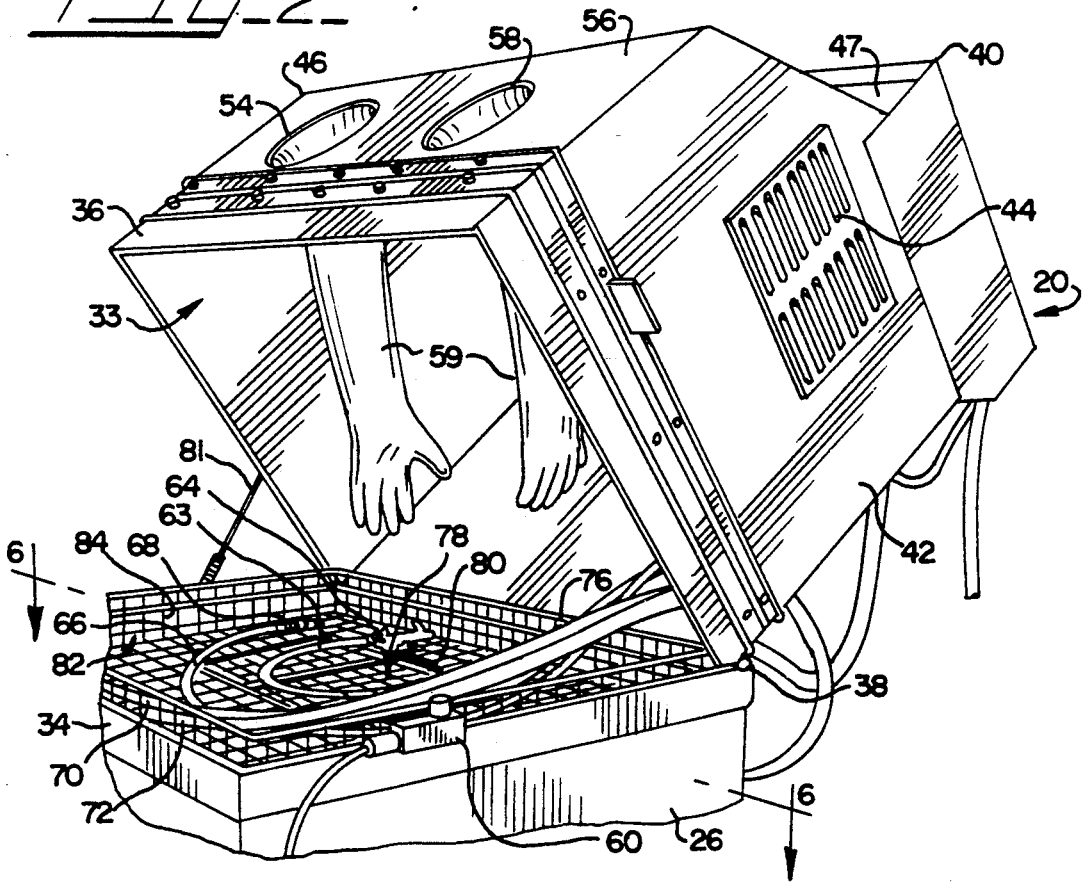
FIG. 2 is a partial showing, in three quarters view, of the cleaner with cabinet pivoted open, and exposing its gloves in depending relation and also the tray consisting of a wire rack in the tray basin for holding parts to be cleaned.

More particularly in the drawings, a high pressure cleaner 20 is illustrated in FIGS. 1, 2 having a base 22 with four sides including a front wall 24 and supporting the machine 26 for cleaning parts. A depending pair of adjacent members constituting switch plates 28 and 30 is carried knee-high for machine controls and is somewhat centrally located on the front wall 24 so as to be convenient to the operator. The base 22 has a right side wall 31 which adjoins the front wall 24 and which carries a receptacle box fragmentarily represented at 32.

Internally, the machine 26 contains a large unobstructed cleaning chamber 33, fully enclosed by a tray basin 34 for parts at the bottom thereof, and by a shoulder-high cabinet 36 at the top providing elbow room for parts' handling by the operator. The basin 34 is supported on the base 22 and supports the cabinet 36 in sealed engagement therewith. A hinge 38 across their rear edge of engagement connects the basin 34 and cabinet 36 so that the operator readily gains access to the parts' tray basin 34 by tilting the cabinet, from closed position, up and back some 45°, thus fully opening the chamber 33 at the front.

The cabinet 36 about the chamber 33 presents thereto a top wall 40 surmounting a continuous series of front, end, and back side walls including a right end wall 42 which is louver-vented at 44, and a two-panel front wall 46. These side walls, front, end, and back, are all translucent. An internal multi-bulb lamp fixture 47 carried in the top by the cabinet top wall 40 infuses a pronounced external luminosity or glow from each of the side walls by shining down therewithin and perforce illuminating the spraying zone and tray basin as well. The fixture carries an on-off light switch 48. By inspection from a distance away, the glow will tell the observer that the switch is on and that the machine is presumably intended for, or already in, operation by someone.

An inclined external window 49 for viewing inside the chamber 33 is inset in a rubber seal frame 50, at about eye level, within a sloping upper panel 52 of the cabinet front wall 46. Therebelow, two spaced armholes 54 through an upstanding lower panel 56 which completes the wall are each one provided with a seal ring as illustrated at 58. The pair of seal rings around the holes 54 provide water tight connections to a shoulder-high pair of sleeved rubber gloves 59 hanging down inside chamber 33. The window 49 and glove armholes 54 on the machine are in its same general central frontal area as the knee-high switch plate members 28 and 30, for coordinated simultaneous use by the cleaning operator.

A safety switch 60 upstanding from its mounting atop the spray basin 34 is engaged and closed by closure of the cabinet 36. The circuit lead for the switch 60 is seen to emerge from a clock device 62 used whereby it presets the running time of machine spraying, and then times out at the end of a spraying interval. The switch 60 takes its electrically open position when the cabinet 36 takes its corresponding open position shown in FIG. 2.

A non-essential commercial floor vac is shown at the left at 251 and is but briefly referred to hereinafter.

HIGH PRESSURE CLEANING HOSE—FIGS. 2, 3

With the machine closed from the position shown and in operation, the gloves 59 inside the cabinet 36 give the arms of the operator access into the chamber 33 to handle and hose the parts as appropriate. Therein, a length of compressed air hose 63 terminates in a hand-valve-controlled air blow gun 64. An adjacent length of high pressure hose 66 carrying washing colution terminates in a spray cleaning hand nozzle 68, which sprays or not under control of the switch plate 28 mounted on the front wall 24 appearing in the machine showing of FIG. 1. A grit suction delivery hose 70 and a companion blast air hose 72 are connected in common to a hand-valve-controlled abrasive or grit blaster gun 74.

When not in use, these supply hoses and their respective nozzle 68 and guns 64 and 74 are rested out of the way along the short upstanding sides of a wide-mesh wire grating removably covering the basin 34 in the machine and forming the basin's tray 76. A smaller mesh wire basket 78 laid upon and depending from the center of the wire tray 76 is for holding small parts and is covered at tray level with hinging wire doors 80 which lift out and upwardly to open the center basket 78. A compressed gas lift strut 81 interconnects the tray basin 34 and cabinet 36 to limit, and also assist in, opening of the cabinet 36.

The basin itself consists of a shallow run-off tank generally indicated at 82 having short vertical walls 84 engaged at the top by the edges of the wire tray 76 as supported therewithin.

RUN-OFF TANK 82—FIGS. 4, 5

More particularly, tank 82 just noted has along its middle a tapered ramp 85 sloping downwardly from a back wall 86 to a junction with the tank bottom 88 which is rectangular and of small size. Also downsloping from the tank walls 84 are two side wings 90 which are joined to ramp 85 and to the rectangular bottom 88 and direct the collecting run-off into the latter.

Figure 5:
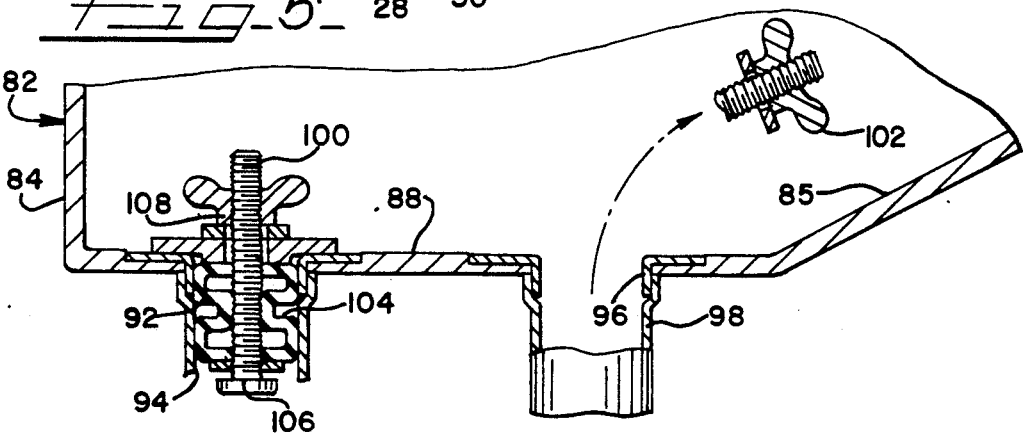
FIG. 5 is a side elevation view of the bottom floor of the basin, taken along the section lines 5—5 of FIG. 4.

A front opening 92 in the tank bottom 88 communicates with a drain downpipe 94, FIG. 5, which receives all material-carrying cleaning solution being expended in the machine. An adjacent rear opening 96 communicates with a dry downpipe 98 which receives grit grains intended for return to storage and re-use.

Two identical stoppers 100 and 102 fit in the respective bottom openings 92 and 96. The stopper 100 which is illustrative of both has a longitudinally collapsible rubber bellows 104 through which extends a draw bolt 106 carrying end washers and, at one end, a wing-shaped tightening nut 108. Hand tightening the nut 108, so as to draw down on the head of the bolt 106 and collapse the bellows end-wise, causes the bellows 104 to expand firmly seated in the opening 92 and seal it.

One opening of these conduits is always plugged in this manner while the other of the openings 92 and 96 maintains its downpipe open.

BASE 22—FIG. 6

Four point support is afforded to the machine 26 at its corners by means of equal height load drums in base 22 consisting of 1st, 2d, and 3d waste water drums 110, 112, 114 and a dry grit drum 116*a*. The latter makes connection at 118 to pipe 98 so as to be fed the grains of returning grit by gravity through the downsloping communication with the tray basin, not shown, as afforded in the way described by its tank opening 96 and dry downpipe 98. The earlier noted grit suction delivery hose 70 extends down into the grit in the drum for supplying the blaster gun 74, FIG. 3.

I prefer steel drums of the same height and of common commercial size up to, perhaps, four of the standard 55 gallon drums for my larger capacity machines 26. In any case, the remaining three are connected hydraulically in series for a gravity flow that ultimately enters an effluent pipe 116. The pipe 116, which leads to the nearest public sanitary sewage line, is tapped at its inlet into the side of the 3d waste drum 114 at a point 117 establishing the waste solution level of the pool maintained in that drum.

An upstream pipe 118*a* of the drum 114 is tapped into the side of the 2d drum 112 at a point 119 higher than the elevation of point 117 in order to maintain the level in the pool of drum 112 slightly above that of the 3d drum 114. In turn, an upstream pipe 122 of the 2d drum taps into the side of the 1st receiving drum 110 at a point 124 enough higher so that the 1st drum's pool is somewhat above the 2d drum's, in their respective levels of waste solution. The solution is thus forced to flow "downhill" in the direction of disposal intended.

Figures 7, 9:
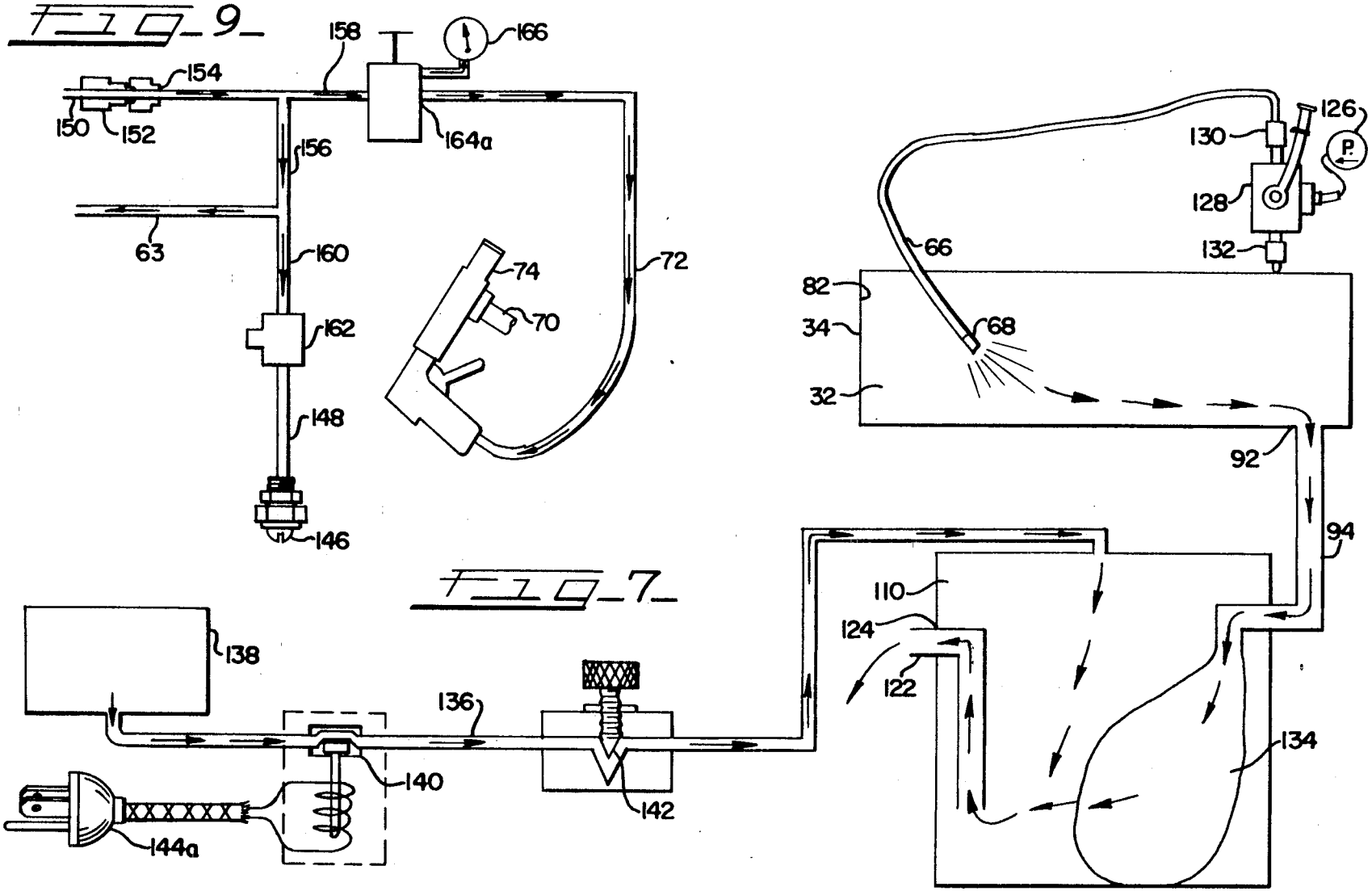
FIG. 7 is a schematic showing of the hydraulic circuit bringing together the respective flows of a neutralizer solution with run-off of expended wash water.
FIG. 9 is a schematic showing of the air circuit feeding the hand-valve controlled grit blaster and compressed air nozzle, and also feeding the solenoid valve controlled defogger nozzle.

The 1st receiving drum 110 can be seen to be on the receiving end of the tank's front opening 92 and the downpipe 94. Illustrative of filtering showings for each water drum, an unnumbered large internal filter bag which appears fragmentarily in cross section in the 3d drum 114 intervenes between it and its upstream pipe 118*a* so as to be the first thing encountered on the receiving end of that pipe.

pH AND PARTICULATE TREATMENT—FIG. 7

In cleaning chamber 32 appearing here schematically the spray, or blast and spray, cleaning operations naturally result in particulates getting into the pre-mixed cleaning solution being supplied by the nozzle 68. So the expended liquid vehicle running off into the 1st drum 110 of the series is carrying with it the chemicals of a cleaning product and all particulates of the sludge fines being held in suspension and the other sedimentary sludge.

Taken overall from its source, the pressurized path of the sprayed solution is from a high pressure pump 126 delivering it outflow into a diverter valve 128 having first and second connections 130 and 132, thence diverted or gated through the hose 66 leading from the first valve connection 130, and finally out from the hand spray nozzle 68 as supplied by the hose. The gravity path of expended solution, with its particulates as accumulated in the basin 34 of the machine, leads from the basin, out through the conduit formed through the necessarily opened opening 92 and drain pipe 94, through a large internal filter bag 134 resting on the floor of the 1st drum 110 and intervening to filter all run-off from drain pipe 94 just as it is entering the drum, thence through the rest of the 1st drum of the series and then through the rest of the series as it continues by the connection 122 of the 2d drum, not shown.

Figure 6:
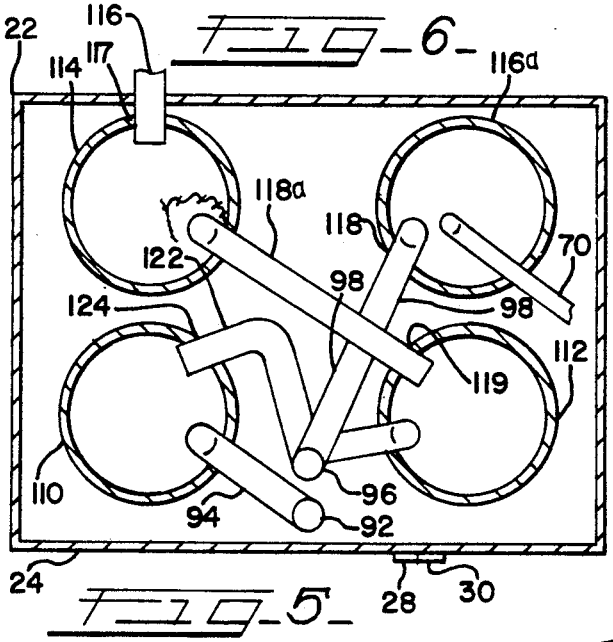
FIG. 6 is a partially sectionalized view, looking down upon the base and taken approximately along the section lines 6—6 of FIG. 2.

Insofar as filter bag showings are concerned the 1st drum 110 can be taken as representative, the bag 134 of which is comparatively coarse meshed, whereas the bags in the 2d and 3d drums of the series are in that order respectively fine meshed and finer meshed. So the particulates are eventually filtered out, with the finer ones removed right at the 3d drum stage as illustrated in FIG. 6, ready to be discharged into the facilities of the public sanitary sewage system.

In regard to the liquid treatment for pH, a line 136 for the liquid is shown in FIG. 7 connecting a neutralizer solution supply tank 138 with the 1st drum 110, by way of a solenoid on-off valve 140 in the line and, in series therewith, a rather schematically illustrated needle valve 142 of usual commercial type for finely adjusting the drip rate of the neutralizer quantity being supplied to the 1st drum. The valve 140 has a pronged line plug 144*a* for use in a standard electrical outlet receptacle, not shown.

COMPRESSED AIR SYSTEM—FIGS. 8, 9

A window mounted air nozzle 146 appearing here is supplied by a compressed air hose 148 enabling it to vigorously blow air in a blanket covering the inside face of the viewing window 49; as previously noted, the window is sealed at 50 in the upper console panel 52 at the front of the machine.

A commercial compressor-air-tank-hose arrangement of type common in repair shops and gas stations is collectively represented in FIG. 9 by the illustrated air hose 150 having the regular male coupling half 152 for receiving thereon the usual complementary air chuck or couple part. A couple part 154 is what is shown actually connected thereto, and it divides its delivery to supply the air to a first leg 156 and to a second leg 158 of the system. The first leg splits into a branch 160 which is connected by a window defogging solenoid valve 162 to the nozzle's air hose 148, and also splits into an air blow gun branch constituted by the compressed air hose 63, FIGS. 3, 9.

The air system's second leg 158 makes connection with a pressure regulator provided with a gage at 166 and providing regulated output 164*a* so as to supply the blast air hose 72 and its grit blaster gun 74 with the air stream to aspirate grit up from the suction delivery hose 70 on the gun. A similar pressure regulator with gage and regulated output 164*b*, FIG. 10, likewise makes connection with the second leg 158 to supply the motor valve for the machine spray option now to be fuller described.

MACHINE SPRAY OPTION—FIG. 10

This optional equipment provides a time and labor saving feature and the system involved, appearing at 168, is readily added during manufacture. Securement of the mechanical parts is conveniently made to existing hinge brackets 170 and 172 attached a the underside of the top wall 40 interiorly of the cabinet. The highly schematically shown bulbs of the down-shining lamp fixture 47 also occupy the wall underside.

More particularly, an oscillating arm 174 is pivotally suspended from the bracket 170 and at its swinging lower end the arm carries an axially aligned, adjustable angle spray nozzle tip 176. The diverter valve connection 132 communicates by way of a hose 178 to the nozzle arm 174 so as to supply the tip 176 with the solution for downspraying cleaning purposes under high pressure.

A reciprocating air cylinder 180 pivoted to bracket 172 has a rod to arm connection 182 at the free end to move the arm and tip 176 through differing arcs of swing such as at 184 in a vertical plane of oscillation across the tray basin 34. Air motor lines 186 and 188 connecting into the respective ends of the cylinder 180 are oppositely controlled with alternate pressurized-exhaust air by a motor valve 190.

The valve 190 is operated by its two-way solenoid 192 to impart the required push-pull motor action at the rod to arm connection 182. The solenoid 192 positions the valve into its opposite settings for this machine wash-down purpose. The valve 190 has a regulated air supply delivered thereto through a hose 194 from the regulated output 164*b* of a pressure regulator and originating with the second leg 158 of the air system, FIG. 9, as source.

Figure 10:
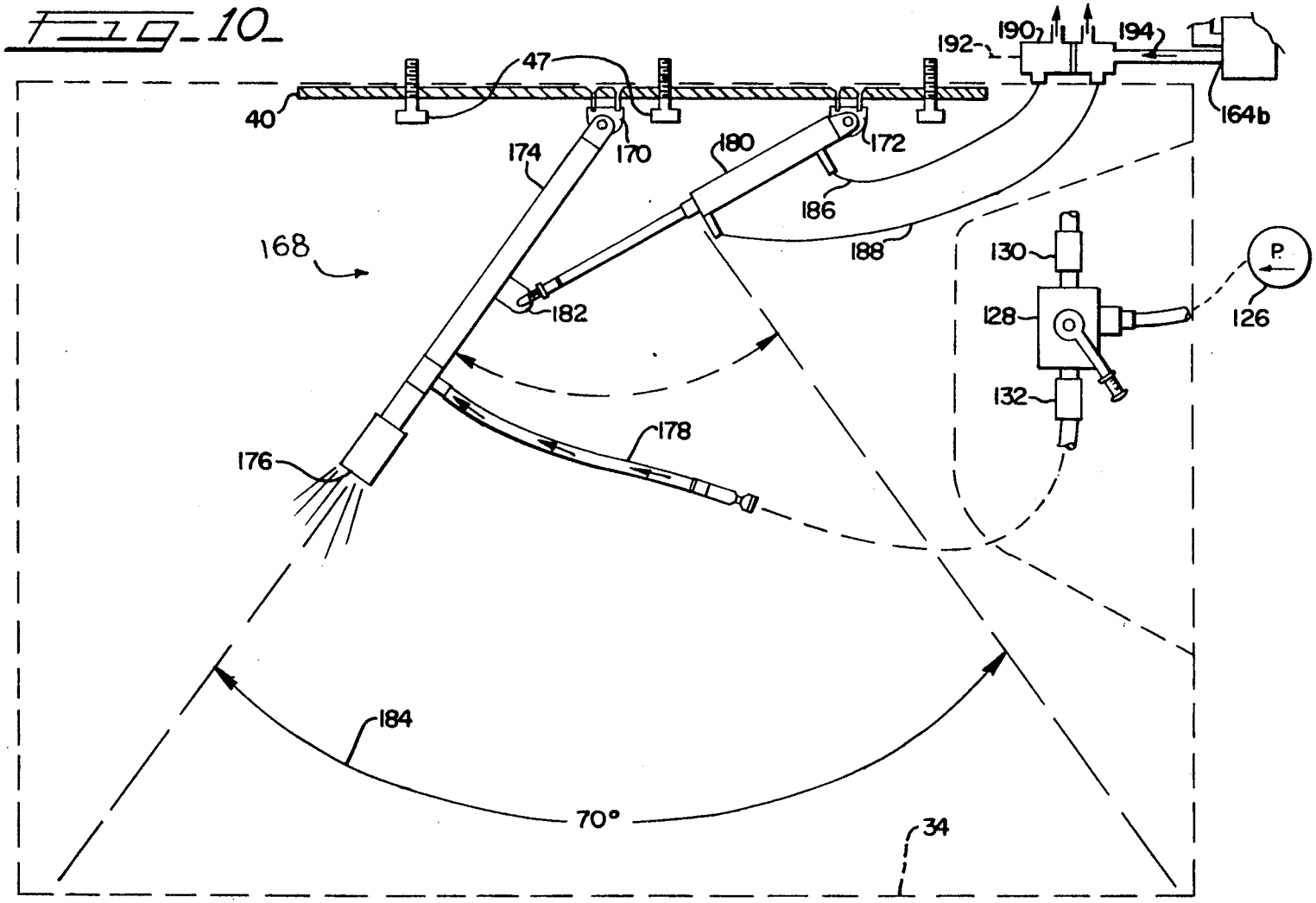
FIG. 10 is a sectionalized front elevational view of the cabinet taken inside along the section lines 10—10 of FIG. 1 and revealing air and hydraulic supplies, and the thus supplied oscillating spray nozzle which runs in timed periods to machine wash parts.

When the FIG. 10 option 168 is provided it will, together with blaster 74 and nozzles 64 and 68, share the common spray chamber 33.

TIMER SCHEMATIC—FIG. 11

Providing coordinated action, a plugged in timer 196*a* as illustrated is common both to the window air solenoidvalve 162 shown in this figure, also in FIG. 9, and to the air-cylinder, two way solenoid valve 190 shown in this figure, also in FIG. 10. The respective windings 198 and 200 of the two solenoid valves 162 and 190 are schematically shown to have a common energized connection 202 leading from a main base socket 204 which receives the plug-in timer 196*a*. The base socket provides ground connection 206 to the air window solenoid winding 198, separate from winding 200's ground connection 208. The base socket 204 is electrically connected in circuit through a pronged plug 210*a*.

A set of independent operating leads 209 for the air window solenoid valve 162 is connected in circuit by a pronged plug 211*a*.

SWITCH PLATE MEMBERS—OPERATOR'S CONTROLS

The switch panel plates 28 and 30 as seen from below in FIG. 12 have knee microswitches 212 and 214 at their free end appearing proximal to the viewer and, at the remote end, they depend from strap hinges 216 and 218 suspending them from the cabinet front wall 24. The knee switch 212 has conductors 220 connecting it to operate the solution spray pump 126, FIG. 10, and neutralizer valve 140, FIG. 7; conductors 222 of switch 214 connect it to initiate a timed activation of winding 198 of the air window solenoid valve 162, FIG. 11.

Figure 8:
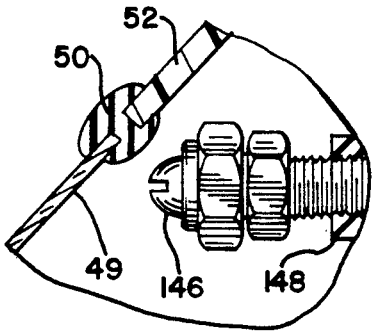
FIG. 8 is a side elevation, along the section lines 8—8 of FIG. 1, taken at the top of the cabinet viewing window and with the air nozzle shown arranged to defog it by blowing with cycled gusts against the inside face.

Hence, slight knee pressure by the operator on switch plate 28, which is to his left, causes spraying in the machine and simultaneous neutralization of the run-off pooling into the drums 1st, 2d, and 3d which support the cabinet and tray basin. Knee pressure at 30 operates the switch 214 to cause defogging of the cabinet window 49, FIG. 8.

A coupling lug 224 pivoting on plate 28 can be manually swung laterally to a bridging position shown at 226 enabling knee pressure of the switch plate 28 to hold both plates 28 and 30 depressed at once. Accordingly, the spraying attended by simultaneous neutralization is also attended by simultaneous defogging, owing to depression of one switch plate and the bridging lug in position at 226 holding the other plate 30 in a like pressed-in position 228.

PRE-SETTABLE POWER OUTLET BOX—FIG. 13

A box 229 according to this schematic showing presents a set of electrical receptacles 144, 210, 211, and 230, plus a lamp connected receptacle 231. A line cable 232 for box 229 is connected by a main supply circuit switch 234 both to the fixture receptacle 231 for the described lamp fixture 47 and to the safety switch 60 on the cleaner's tray basin.

In operation, the cabinet 36, FIG. 2, by engagement with the safety switch 60 on the tray basin 34 functions to open and close the switch 60 as the cabinet is respectively opened and closed. The prongs of a plug at one end of a lamp cord 231*a*, FIG. 13, seat in the receptacle 231; at the other end the lamp cord is switch-connected at 48 to the lamp 47, FIG. 1.

Figure 12:
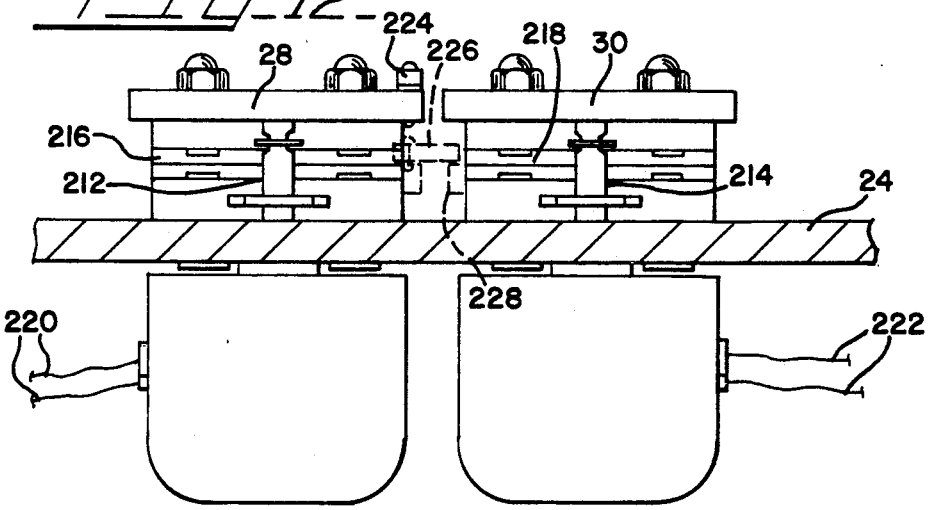
FIG. 12 is the base's fragmentary bottom plan view, as taken along the section lines 12—12 at the front in FIG. 1, to show the base-carried cooperating knee switches and their depending treadle-like panels from below.
Figure 13:
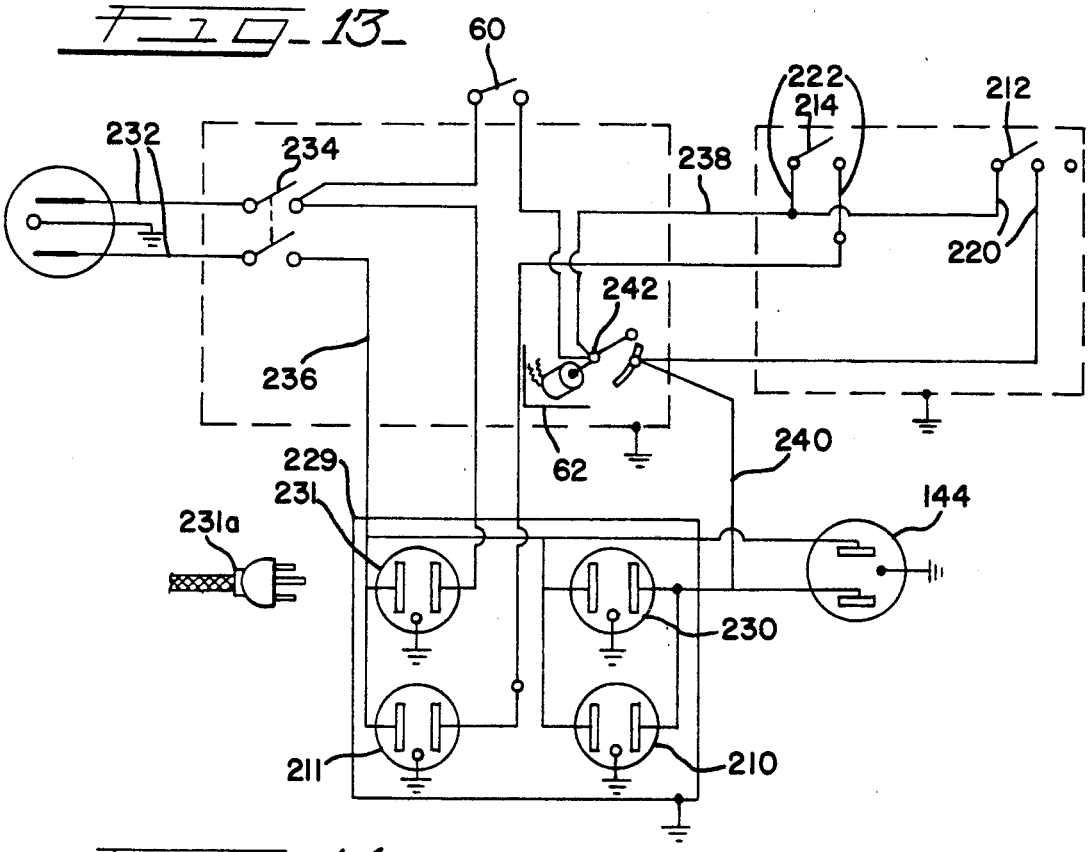
FIG. 13 is the main electrical schematic, showing the particular receptacles to which the electric cords are plugged in to power the various operating components of the cleaner.

By one lead therefrom, the safety switch 60 supplies switch energizing current to the line conductors 222 of window air knee-switch 214 and to the line conductors 220 of pump knee-switch 212, FIGS. 12, 13.

Figure 11:
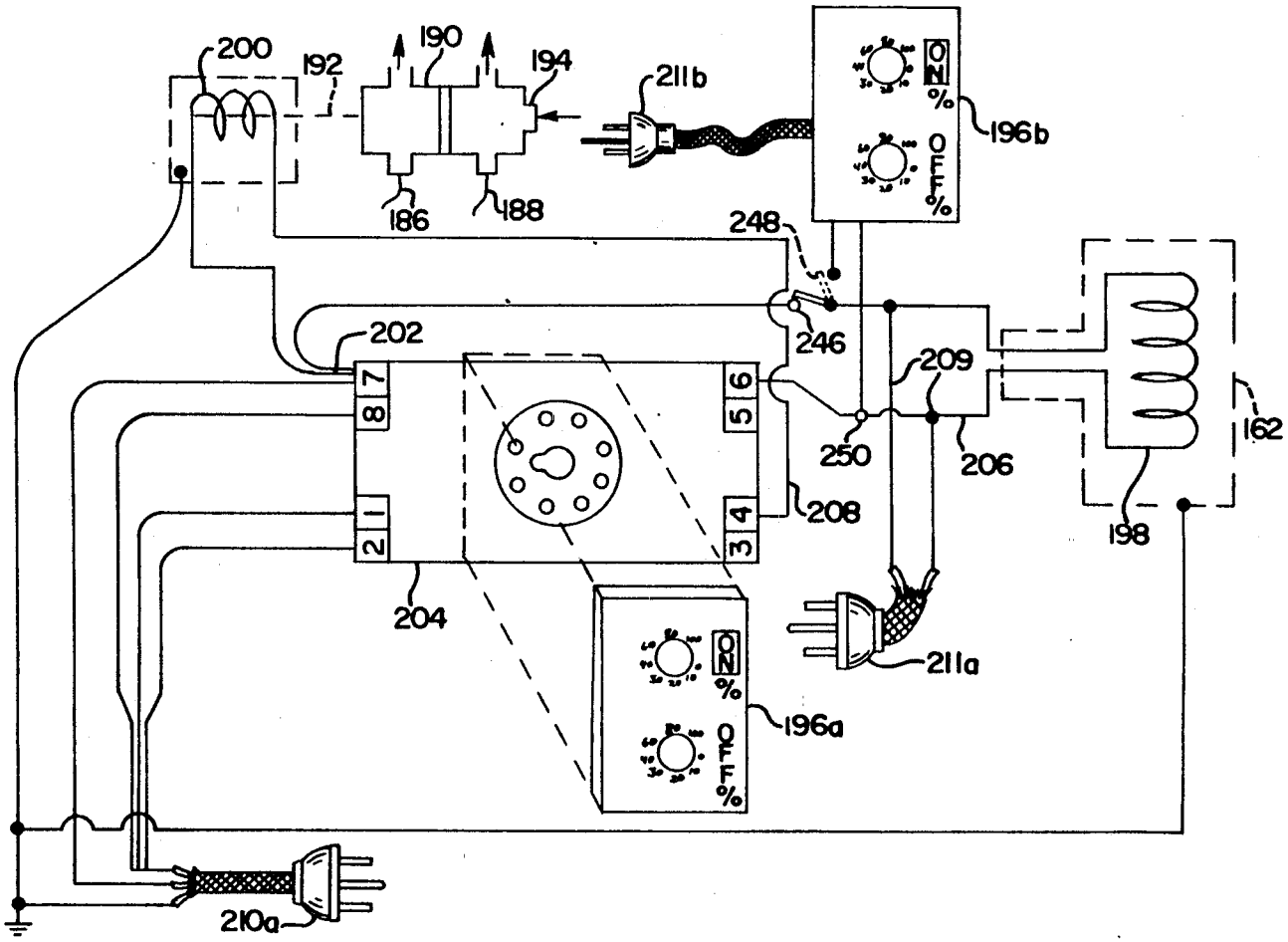
FIG. 11 is a schematic showing of the electrical cycle timing circuit for machine washing as viewed in FIG. 10, and also for the desired intermittent blowing action of the FIG. 8 defogger.

By another such lead connection, the safety switch 60 supplies power through a feed line 240 common to the receptacle 144 provided for neutralizer line plug 144*a*, FIG. 7, also to the receptacle 210 for line plug 210*a*, FIG. 11, for timer-cycling spray arm motion and defogging spurts, and further to the power receptacle 230, FIG. 13, for a pronged line plug to be described which supplies power to put the cleaning solution under high pump pressure for its applications according to FIGS. 7, 10.

The receptacle 211 and the just discussed receptacles 114, 210, 230, and 231 share a ground return line 236 common thereto and connected to the main switch 234.

The arrangement of FIG. 13 affords two main circuit controls over operation of the machine. The purpose of one control is to give a pre-settable running time for solution pumping and neutralization as fed by receptacles 230, 144, and a concurrent running time at 210 for maintaining successive cycles of spray arm oscillations and cycled defogging Hence, the clock device 62 contains an interval timing mechanism 242 which intervenes and is adjustably settable to connect the switch 60 and the receptacle feed line 240 for various running times such as a twenty minute period of machine spray washing, which automatically terminates.

For purposes of another control over coordinated spraying, neutralizing, and defogging, the receptacle feed line 240 is directly connected to one of the line conductors 220 to receive output from the knee switch 212. So, following timed termination of some period of machine spray, the operator by knee pressure can put the machine back into operation for some finishing touches when desired, perhaps after turning or inverting one part or another for different cleaning exposure.

The output-one of the conductors 222 of the window knee air switch 214 is directly connected to the receptacle 211 provided for line plug 211*a* which supplies the defogging solenoid valve 162, FIGS. 9, 11. The switch 214 can, as earlier described, be optionally operated with or independently or the companion knee switch 212. In either case, window air is continuously supplied for defogging while the switch 214 is being held closed.

MACHINE SPRAY SET-UP

In a machine equipped for the option appearing in FIG. 10, the operation is set up by handle setting the diverter valve 128 into the gated position shown, directing all output of the washing solution from the pump 126 downwardly and over to the nozzle arm 174 and spray tip 176.

In FIG. 13, the set-up of box 229 can be visualized as if the lamp line receptacle 231 and as if the pressure pump receptacle 230 are each covered by their appropriate electric plug; further, consider the other receptacles to be likewise covered by their respective plugs 144*a* of FIG. 7, and 210*a* and 211*a* of FIG. 11. The setting of the main switch 234 brings the line cable 232 into the circuit, and closing down the cabinet sets the safety switch 60 closed. The clock interval device 62 is pre-set and then set running, whereupon the machine spray operation runs for a pre set period and then clocks out to stop spray and neutralizing, always together.

In the immediately preceding section under the outlet box sub-head, the finishing touches mentioned in connection with machine spray can also be readily accomplished in the event hand spray is preferred. In that event, the diverter valve 128 from pump 126, FIG. 7, is handle set in the gated position shown to pressurize the nozzle hose 66 only. Accordingly, it will be the hand nozzle 68 which delivers spray to one part or another for some missed spot or generally different cleaning exposure.

HAND SPRAY SET-UP

In a basic machine adapted for spraying solely by hand nozzle 68, FIG. 7, the diverter valve 128 is handle set, as illustrated and just discussed, so that the hose 66 receives all flow from pump 126 and supplies the nozzle 68 therewith. Anyway, the basic machine as offered does not come equipped with the machine wash-down option.

In FIG. 11, the basic machine is set up by the provision of another similar repeat-cycle, delay relay timer 196*b* having a similarly pronged line plug 211*b* like the other ones such as the supply plug 210*a* for relay timer 196*a*. A selector switch is thrown from its solid line solenoid energizing position against a contact 246 and is re-set to the broken line switch position 248 for pulse energizing the air window solenoid 198 from timer 196*b*. The timer has a ground return contact 250 connected in the solenoid's ground connection circuit 206.

For basic hand spray as thus set up in FIG. 11, all the machine spray option equipment appearing therein to the left of contacts 246 and 250 is omitted from the machine, and a likewise omission is the pronged plug 211*a* and its connection to the window valve circuit of solenoid 198.

In FIG. 13 for hand spray only, the set up requires that the so-called spray arm receptacle 210 be kept unoccupied, if not eliminated from box 229 altogether. The device 242 for timing the intervals of running the machine spray arm is of course eliminated, by reason os the machine spray option of FIG. 10 not being included.

The receptacle 231 is set up with the line plug 231*a* from the lamp switch 48, FIG. 1, plugged thereinto and, as similarly plugged into, are the pump power receptacle 230 and the receptacle 144 which holds the neutralizer line plug 144*a*. With the just mentioned plug 211*a*'s omission, in lieu thereof knee air switch receptacle 211 receives the air window solenoid plug 211*b*, FIG. 11, for the window valve 162. Accordingly, the intervening repeat cycle delay timer 196*b* pulses the air solenoid 198 causing the solenoid window valve 162 to deliver air in discrete bursts across the viewing window in the spray cabinet.

So the hand spray is strictly operator controlled: he perforce closes the activating safety switch 60 when he closes the cabinet to start spraying, he runs the pump powered spraying and the simultaneous neutralizing with the knee switch 212 and, simultaneously therewith or not, he runs the pulsing defogging puffs to clear the window with the companion knee switch 214, FIG. 13

ORDINARY HOUSEKEEPING WASH-DOWN—FIG. 14

Illustrated here is an example of typical commercially available equipment ordinarily found in shops and used by maintenance in their housekeeping chores for vacuuming and for hot soap wash-downs of wall surfaces, repair work area floors, and the like; obviously no claim to novelty is here asserted. Usually included is a vacuum cleaner 251 which completes the regular housekeeping equipment scene but which is not germaine for present purposes.

Intentionally briefly put therefore, a liquid soap agent from a bottle 252 is mixed through a soap valve 254 with hot water from a tank heater 256. Soap is a term of convenience and description herein generically covering sudsing powders, granules, and wash solutions employed as commercial cleaning products and being of ordinary work soap, soap-like, or detergent composition.

The soap solution mixture from valve 254 is drawn into the present system's high pressure pump 126 powered by an electric motor 260. A line cord is shown connecting the pump motor 260 and a pronged plug 230*a*. The plug 230*a* is received by the power receptacle 230, FIG. 13, to furnish the soap solution under high pressure for either of the cleanings, i.e., by machine spray or hand spray.

The water heater 256 has a hose 262 by which it receives water supplied by the facility where the equipment is located. The heater 256 further has a burner which is under it, not shown, and is fueled from a fuel tank 264. A frame 266 for the equipment carries a pair of dolly wheels 268 for hand trucking the equipment. Lying just outside one wheel 268 is the usual shop air hose 150 with its regular couplers 152 and 154, FIGS. 9, 14.

My machines are sold as-is, with connections adapted to receive outside sources of electric power, hot washing solution under pressure for impact spraying, and compressed air. Providing same is the sole responsibility of the purchaser.

To realize the various operations of the machine now to be outlined, it is therefore to be presupposed that all inputs necessary from the outside are present and available.

BLASTING GUN ONLY

Figure 3:
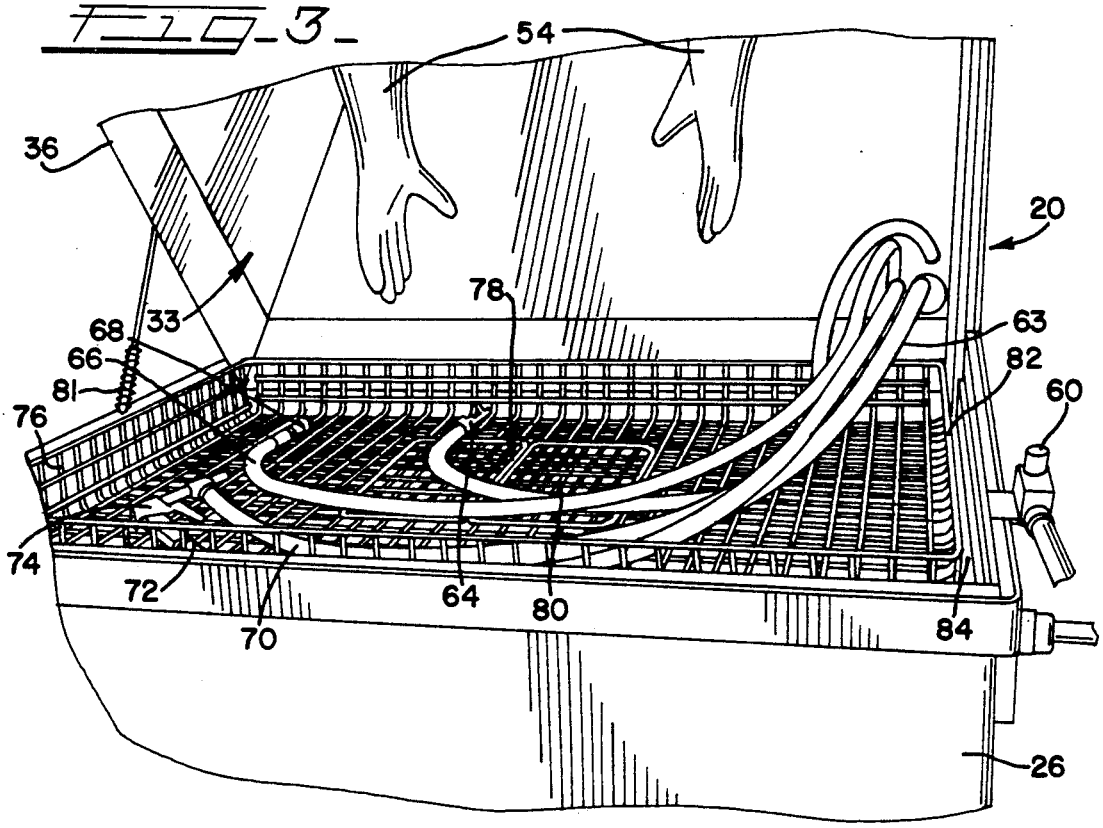
FIG. 3 is confined to the tray basin, as viewed from the front and from above, and shown with various hoses including hand-valve-operated hoses thereon.

With the tray 76 and small mesh basket 78, FIG. 3, removed from the tray basin, the operator plugs opening 92 and drainpipe 94 as illustrated, and the sole opening open is the opening 96 as shown, which is connected to the dry downpipe 98, FIG. 5. The downpipe 98 exclusively carries grit and conducts it at 118 into the dry grit drum 116, FIG. 6.

Because of its effectiveness, favorable price, and general availability, I prefer using ordinary boiler slag particles as the air-borne abrasive. Dry sand is another good abrasive to use as an alternative, and also other gritty materials with small sharp particles, and some particulates of glass or glassy substances.

If treatment is needed on a succession of parts having just rusty patches or rusty coats then, in order, the first of the batches is loaded into tank 82; alternatively, and particularly for heavier ones of the batches, the wire tray is desirably reinserted in the tank as the support.

With the machine thus loaded and the cabinet 36 closed and the operator's hands and arms inserted in the gloves 59, the operator manipulates the parts to expose their rusted areas with one hand and; with the other, grit blasts the rust off with the hand-valve-controlled blaster gun 74. The machine is then unloaded, and the cleaned parts replaced by a second batch which is then de-rusted, so on.

At intervals, the accumulating layer of rust and grit in the tank 82 is swept off the bottom down through the dry grit opening and downpipe 98, and thereupon stored dry in the drum 116 for re-use in the blast nozzle.

HAND SPRAY ONLY

The stopper 102 is reinstalled and the stopper 100 is unplugged from the drain downpipe 94 and front opening 92, FIG. 5. The operator uses the hand nozzle 68 and in sequence impact sprays successions of batches requiring that oily grime be washed off. The procedure compared to the immediately preceding section can be, as well, adopted here because they are about the same though differing markedly in result.

With each load of the batches of parts, the operator manipulates one part at a time with one gloved hand and, with the hand nozzle in the other hand, directs the washing solution and washes off the coated areas.

The hand spray set-up of the machine was so termed and fully detailed in a preceding section directed to FIGS. 7, 11, the pertinent figures of the drawings. For purposes of keeping the air blow plate 30, FIG. 1, from requiring his separate attention, the operator usually but not necessarily pivots the lug 224 into its bridging position and so can easily coordinate his knee-switching with his hand spray and hand manipulation. Expended solution pours from the tank 82 down the front opening 92.

MACHINE SPRAY ONLY

The same as just noted with hand spray, the opening for drain pipe 94 is unplugged and the dry downpipe opening 98 is the one stoppered. The operator sets the timing mechanism of clock device 62, FIG. 1, for an interval of running time of the machine suitable for the succession of batches, and then machine sprays the first load to free parts of their oily grime, followed by the second, and so on.

When the device 62 terminates the running time of each batch, the operator is required to return and attend the machine by opening up and inspecting the parts as cleaned. For cleaning touch up of a part, if any, for a missed spot, further timing is uncalled for; the operator proceeds with a machine spray or else hand spray follow-up simply by following the knee switching procedure as previously described.

MIXED

Confronted by a mixed assortment, the operator makes up a load or at least a part load of rusty only parts. He applies the blasting-gun-only procedure, except that in the way already described one of the steps is no longer appropriate. What he does by way of departure therefrom is to seeing that it is the drain pipe 94 which is unplugged and that the dry downpipe opening 98 is the one stoppered. Abrasive and rust fall in a light coat onto the bottom of tank 82, FIG. 4.

The operator impact sprays the next load. The spray solution washes off and carries with it the grimed grease from the parts, and then washes off and carries with it the coat of abrasive and rust grit from the bottom of the tank 82. The resulting run-off of sludged soapy solution flows down and out drain pipe 94 for its described filtration and neutralization treatment necessary for legal discharge into the community's sanitary lines.

Alternating the parts can go on indefinitely in this fashion, with one rusty batch being next followed by parts impact sprayed for oily grit, and so on with this multistage machine operation.

OILY RUST

Figure 4:
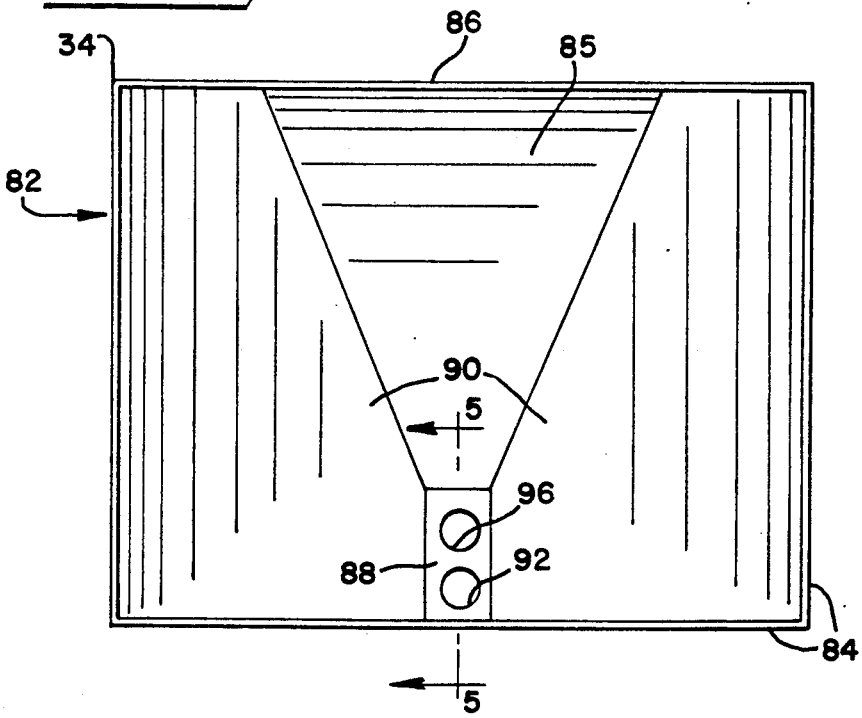
FIG. 4 is a top plan view of the basin itself with the tray removed.

A load of parts so coated is kept in the machine for two-stage treatment in sequence. Impact spraying first removes all oil and clinging grit which would otherwise cling as a lubricant barrier to sharp air-blasted particles. Gun blasting the surfaces with abrasive grains then removes what is residual, all the surface coat of rust. The air blow gun 64, FIG. 4, is of course always available for blowing off particles, wetness, and so forth; blow drying here in case it is used by the operator between these two treatments will speed up and facilitate the final one, the gun blasting step for residual rust.

And, in any case, the next load of parts so coated is given the double treatment, which is continued for further loads in succession in the machine. Solution run-off from the de-oiling and de-rusting moves off as a thin sludge so as to keep the bottom of the shallow tank 82 fairly well washed off and consistently so. The sludge is filtered and neutralized in the regular way.

NEUTRALIZATION

Neutralization as used here is a relative term depending upon environmental requirements, if any, for discharges. They tend to vary from one local sanitary disposal system to the next. Soap and soapy solutions, as used here to include detergents and actual soaps, have varying values in their pH readings depending upon the specific chemical composition, sudsing ingredient, and so on.

Figure 14:
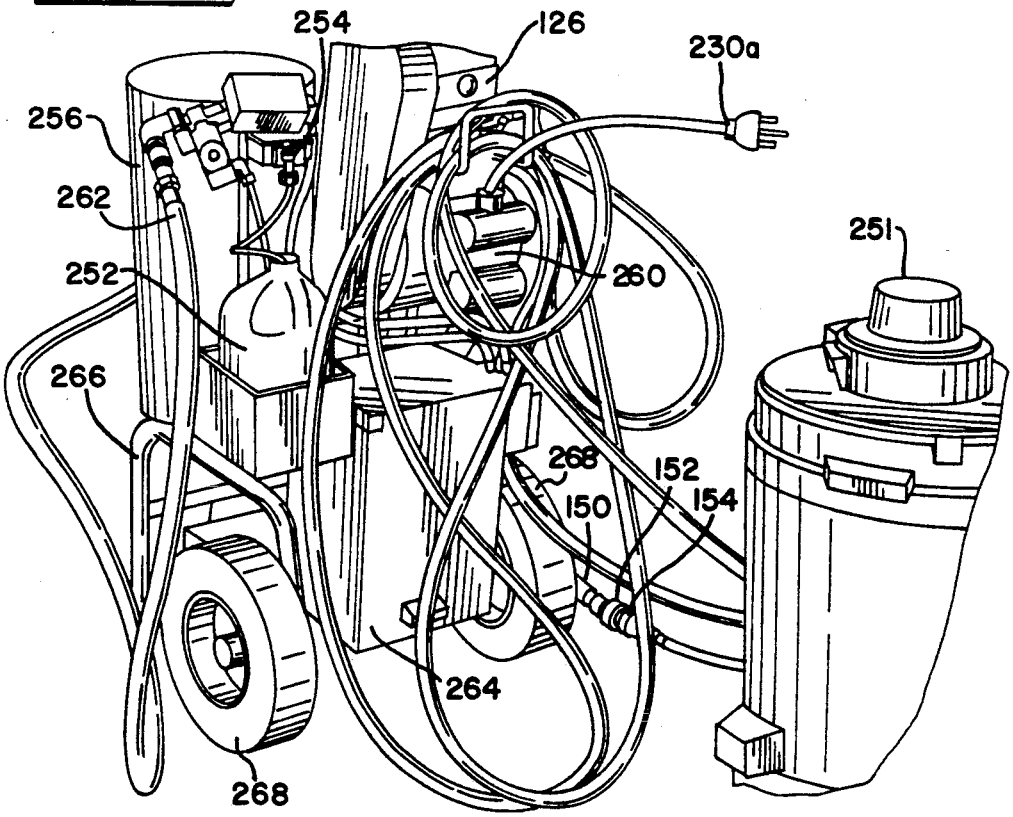
FIG. 14 isometrically shows typical commercially available and commonly used wash-down housekeeping equipment complete with push carriage, and also a source hose for compressed air.

Simply by way of a general and rough figure for illustration a wash water solution made using one brand of bottled cleaning agent employed in existing commercial housekeeping equipment as shown in FIG. 14 can have a pH of about 10. The pH requirements for discharges acceptable by sanitary disposal systems are never as stringent as the exactly neutral 7 pH reading. Because the agents primarily contemplated here are well on the alkaline side of 7 pH, the supply of neutralizer solution in tank 138, FIG. 7, must definitely be acidic. Usable acids supplied to tank 138, FIG. 7, include hydrochloric and, on the more moderate side, muriatic acid and even vinegar to produce the acceptable pH level in the effluent.

As a precaution where the operation happens to be in a municipality, for example, the working choice among the variety of these effective neutralizers should be checked out for final approval at the local city sewage treatment plant.

Machine calibration made with valve 142, FIG. 7, is done with the spray running and with the effluent from drum 114, FIG. 6, being tested for pH. The acid drip rate into the 1st drum 110 is rather low and is set to materially reduce the 10 pH so as to approach 7 pH as nearly as required. On the other hand, an effluent normally reading significantly less than 7 in its pH test will require the tank 138 to drip in an alkaline neutralizer solution so as more nearly to approach a 7 pH final value.

Circumstances can arise with the machine apparently idle and opened up, when the neutralizer could still be kept running while the pump motor could have been disconnected at 230*a*, or else it or the spray pump itself could have broken down. Hence, the cabinet safety switch 60, FIG. 13, here constitutes an essential feature insuring that there can be no accidental run-on whatever of neutralizer quantities while the plastic cabinet stays opened up, attended or unattended. That is, it can be viewed the other way around that the hot tank spray washer is what is doing the necessary neutralizing on the flow of acid; either one without the other constitutes unwanted non-neutral discharge.

It is the consolidation of the foregoing features, spray impact cleaning, neutralizing and all, into the one machine that gives my invention its highly desirable character. It retains this desirability in absence of community regulation, such as where raw sewage discharges are allowed; the fact still holds that it is the user's ecological responsibility to the environment to avoid making highly non-neutral discharges and avoid producing lasting chemical consequences resulting in any way from the present advantageous spray impact cleaning at the spraying temperature hereof.

The disclosure foregoing is offered for public dissemination in return for a patent.

Variations within the spirit and scope of the invention described are equally comprehended by the foregoing description.

What is claimed is:

1. Parts cleaner (20) including, in combination therein, manipulatable pressure spraying means (68, 176) operable to apply cleaning solution to separate off the material being carried from the surface of parts as cleaned of such material;

additive means (14) operable to introduce pH neutralizer quantities into the resulting material-carrying solution run-off from the spraying;

an operating switch member (28, 62) and power circuitry (24) controlled thereby connected to the spraying means and to the additive means to simultaneously apply cleaning solution to the parts and to be neutralizing the material-carrying run-off therefrom down to acceptable pH level;

chamber forming means in the cleaner comprising a collecting tray basin constructed and arranged to issue forth the run-off;

a spray cabinet which mutually with the basin defines a common chamber;

said spray cabinet including a top, and translucent side walls resting on the tray basin for support; and an internal lamp fixture carried by the cabinet top creating external luminosity to the cabinet walls and shining down within the chamber and illuminating the tray basin.

2. A parts cleaning as in claim 1 and comprising a hot tank spray washer;

said spraying means including a nozzle, and a support guiding the nozzle for back and forth movement in an overall path spraying hot wash solution across parts to be spray impact cleaned; and power means connected to the said support to cause the nozzle to sweep in repetitive cycles.

3. The parts cleaning according to claim 2, characterized by:

control means connected to the power means to adjust the actual length of sweep availed of by the nozzle within the overall hot spray path afforded.

4. Parts cleaner (20) including, in combination therein, manipulatable pressure spraying means (68, 176) operable to apply cleaning solution to separate off the material being carried from the surface from parts as cleaned of such material;

additive means (140) operable to introduce pH neutralizer quantities into the resulting material-carrying solution run-off from the spraying;

an operating switch member (28, 62) and power circuitry (240) controlled thereby connected to the spraying means and to the additive means to simultaneously apply cleaning solution to the parts and to be neutralizing the material-carrying run-off therefrom down to acceptable pH level;

a collecting tray basin over which the parts rest to receive a spray;

a shoulder-high spray cabinet part mounted on the basin having inside gloves for spray manipulation and having arm holes at the frontal area to which the gloves are connected and sealed thereat; and a base for the cabinet and basin, and constructed and arranged with the operating switch member comprising a knee-switch supported thereon within the immediate frontal area of the cleaner defined by the sealed gloves and holes.

5. The invention according to claim 4, wherein:

said supporting base including drum means for support of the cabinet and basin and connected to receive therein from the basin aforesaid, as run-off, the material-carrying solution;

said drum means further connected to the additive means so that the pH neutralizer quantities being received are introduced therein into the collecting run-off.

6. Parts cleaner (20) including, in combination therein, manipulatable pressure spraying means (68, 176) operable to apply cleaning solution to separate off the material being carried from the surface from parts as cleaned of such material;

additive means (140) operable to introduce pH neutralizer quantities into the resulting material-carrying solution run-off from the spraying;

an operating switch member (28, 62) and power circuitry (240) controlled thereby connected to the spraying means and to the additive means to simultaneously apply cleaning solution to the parts and to be neutralizing the material-carrying run-off therefrom down to an acceptable pH level;

a shoulder-high spray cabinet part having a window opening occupying a frontal area and a viewing window inset therein and sealed thereto;

a base part holding the operating switch member knee-high thereon;

a tray basin for collecting the spray, said collecting basin supporting the spray cabinet part, and being supported by the base part in a manner with the base part relatively oriented so as to support the knee-high switch member held thereby within the cleaner's frontal area which is occupied by the inset window and window opening.

7. The invention according to claim 6 characterized by:

said operating switch member comprising a knee-switch;

a window blower associated with the window; and switch means and power circuitry controlled thereby connected to the window blower to blow and clear off the window;

said operating switch member common to the knee-switch and said switch means to simultaneously spray and clear the window.

8. The invention according to claim 7, wherein:

said blower circuitry having a timer repetitively interrupting the circuitry and the blower's air so as to blow in discrete air pulses.

* * * * *